US008689995B2

(12) United States Patent
Letica, II et al.

(10) Patent No.: US 8,689,995 B2
(45) Date of Patent: Apr. 8, 2014

(54) CHILD RESISTANT, TAMPER EVIDENT CONTAINER

(71) Applicant: Letica Corporation, Rochester, MI (US)

(72) Inventors: Anton Letica, II, Bloomfield Hills, MI (US); John R. Selina, Brighton, MI (US)

(73) Assignee: Letica Corporation, Rochester, MI (US)

( * ) Notice: Subject to any disclaimer, the term of this patent is extended or adjusted under 35 U.S.C. 154(b) by 0 days.

(21) Appl. No.: 13/674,465

(22) Filed: Nov. 12, 2012

(65) Prior Publication Data

US 2013/0105482 A1 May 2, 2013

Related U.S. Application Data

(63) Continuation-in-part of application No. 12/961,662, filed on Dec. 7, 2010, now Pat. No. 8,308,010.

(51) Int. Cl.

| | |
|---|---|
| ***B65D 41/06*** | (2006.01) |
| ***B65D 41/36*** | (2006.01) |
| ***B65D 43/10*** | (2006.01) |
| ***B65D 55/12*** | (2006.01) |

(52) U.S. Cl.

USPC ..... 220/298; 220/296; 220/784; 215/216; 215/221; 215/222; 206/807

(58) Field of Classification Search

USPC ..... 220/266, 296, 298, 784; 206/807; 215/216, 221, 222

See application file for complete search history.

(56) References Cited

U.S. PATENT DOCUMENTS

| | | | | |
|---|---|---|---|---|
| 5,078,288 | A * | 1/1992 | Fuchs | 215/209 |
| 7,942,280 | B2 * | 5/2011 | Priebe et al. | 215/217 |

* cited by examiner

*Primary Examiner* — Anthony Stashick
*Assistant Examiner* — Jennifer Castriotta
(74) *Attorney, Agent, or Firm* — Young Basile Hanlon & MacFarlane PC

(57) ABSTRACT

Two embodiments of a molded plastic container/closure combination are described. Each can be structured to provide a child resistant opening feature and, optionally, a tamper-evident feature. In both embodiments, the closure has radially extending bayonets arranged around an outer skirt, which bayonets can be rotated into a position underlying semi-annular ribs in a beam molded integrally with the sidewall of the container. Rotation of the closure in the unlocking direction is opposed by a structure which requires depression of a release tab downwardly. In one embodiment, depression of the release tab requires that a frangible element first be fractured and removed from the container sidewall. In the second embodiment, depressing the release tab is made possible by a living hinge formed on one side of the release tab.

4 Claims, 12 Drawing Sheets

FIG. 6
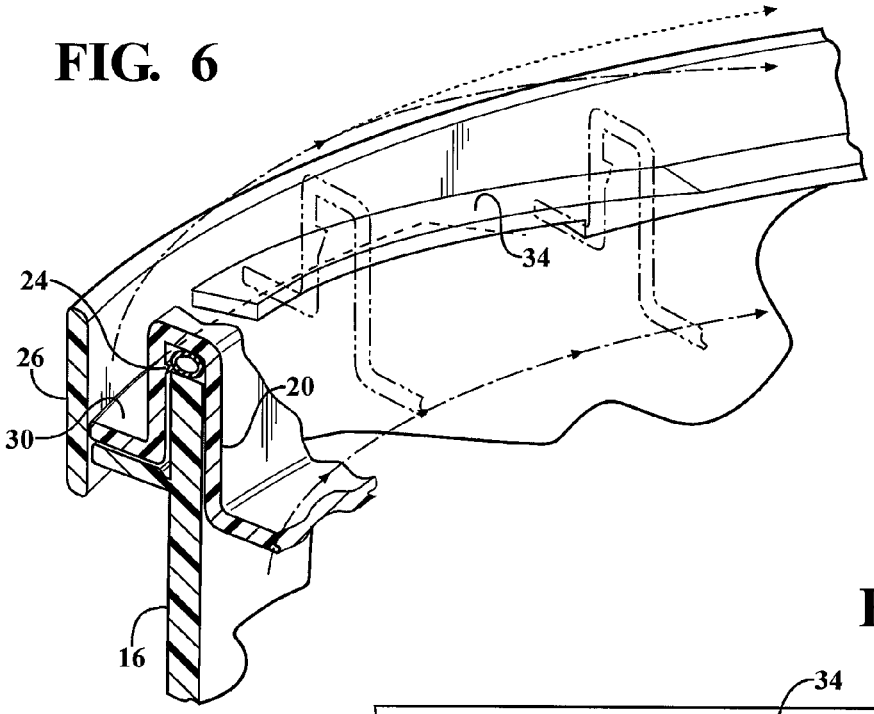
FIG. 7
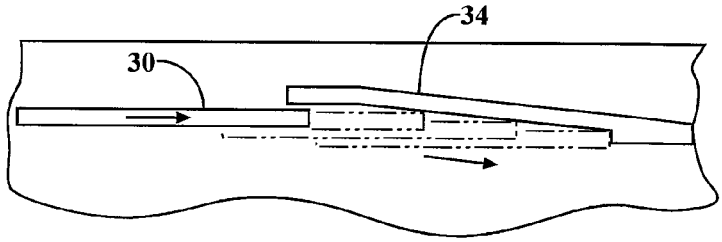
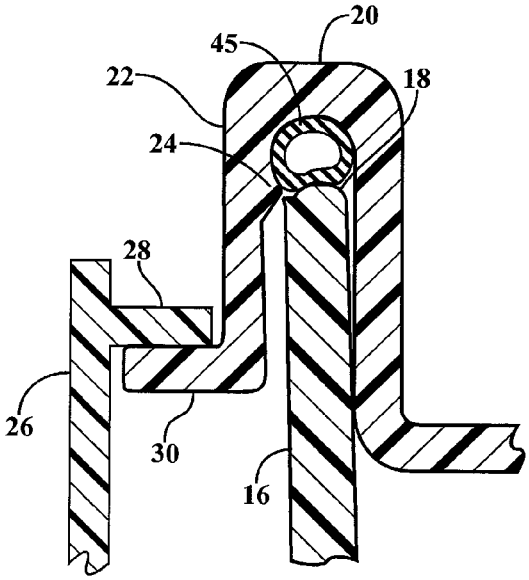
FIG. 8

CHILD RESISTANT, TAMPER EVIDENT CONTAINER

CROSS REFERENCE TO RELATED APPLICATION

This application is a continuation-in-part of the co-pending U.S. patent application Ser. No. 12/961,662 filed Dec. 7, 2010, the disclosure of which is incorporated herein.

FIELD OF THE INVENTION

This invention relates to molded plastic container/closure combinations and more particularly to a container/closure combination having one or more of the following features:

(a) a tamper evident feature;

(b) a child resistant opening function; and (c) a feature wherein rotation of the closure lifts the closure to facilitate removal of the closure from the container.

BACKGROUND OF THE INVENTION

Molded plastic container/closure combinations are well known and used in a variety of sizes and configurations to ship, market and store various substances such as food products, adhesives, sealants, spackling compounds and laundry detergents. To prevent or at least indicate pilferage or possible contamination of the contained goods, it is known to incorporate a "tamper evident" feature that leaves physical evidence that the container may have been opened before reaching the end user. Tear bands are commonly used for this purpose.

Another desirable feature is to make the container opening procedure too complex for young children to perform. This may be particularly important in the case of toxic products within the container.

BRIEF SUMMARY OF THE INVENTION

The present invention provides a molded plastic container/closure combination having one or more of the following features.

First, the container/closure combination can have a tamper evident feature to provide a physical indication in the event the container is opened prior to reaching the end user. As hereinafter described in greater detail, this feature, when present, is provided by forming a release tab on the container which requires at least a partial fracture to allow opening of the container. The fracture is evident from visual inspection of the container and provides evidence of possible tampering.

Secondly, the present invention provides a child resistant feature which is achieved through the incorporation of mechanisms which complicate the opening process beyond the capabilities of many younger children. In general, this feature is achieved by providing a release tab which must first be flexed or depressed to allow a subsequent rotation of the closure relative to the container, which rotation is necessary to fully release the closure from the container. This complicated manipulation is relatively simple and straightforward for mature humans but, in part because it requires two hands and in part because it requires a coordinated combination of actions, is too complicated for many children.

Finally, the present invention can incorporate a closure removal facilitation feature which makes it easier with persons with limited manual dexterity to remove the closure from the container. In general, this is provided by means of an arrangement in which rotation of the closure in the opening direction causes the closure to lift somewhat relative to the container. This is achieved in the illustrative embodiment by a combination of radially extending closure elements and container-mounted ramps which lift the elements when the closure is rotated to place the elements in removable positions.

The various features and advantages of the present invention will be best understood from reading the following specification which describes an illustrative embodiment in detail. This description is to be taken in combination with the accompanying drawings.

BRIEF SUMMARY OF THE DRAWINGS

The description herein makes reference to the accompanying drawings wherein like reference numerals refer to like parts throughout the several views and wherein:

FIG. 6 is a perspective view partly in section showing the manner in which the closure coacts with the container during rotation;

FIG. 7 is a side view of a detail from FIG. 6;

FIG. 8 is another cross-sectional view showing the relationship between the container sidewall and the closure in a latched and locked condition;

DETAILED DESCRIPTION OF THE ILLUSTRATIVE EMBODIMENT

Figure 1:
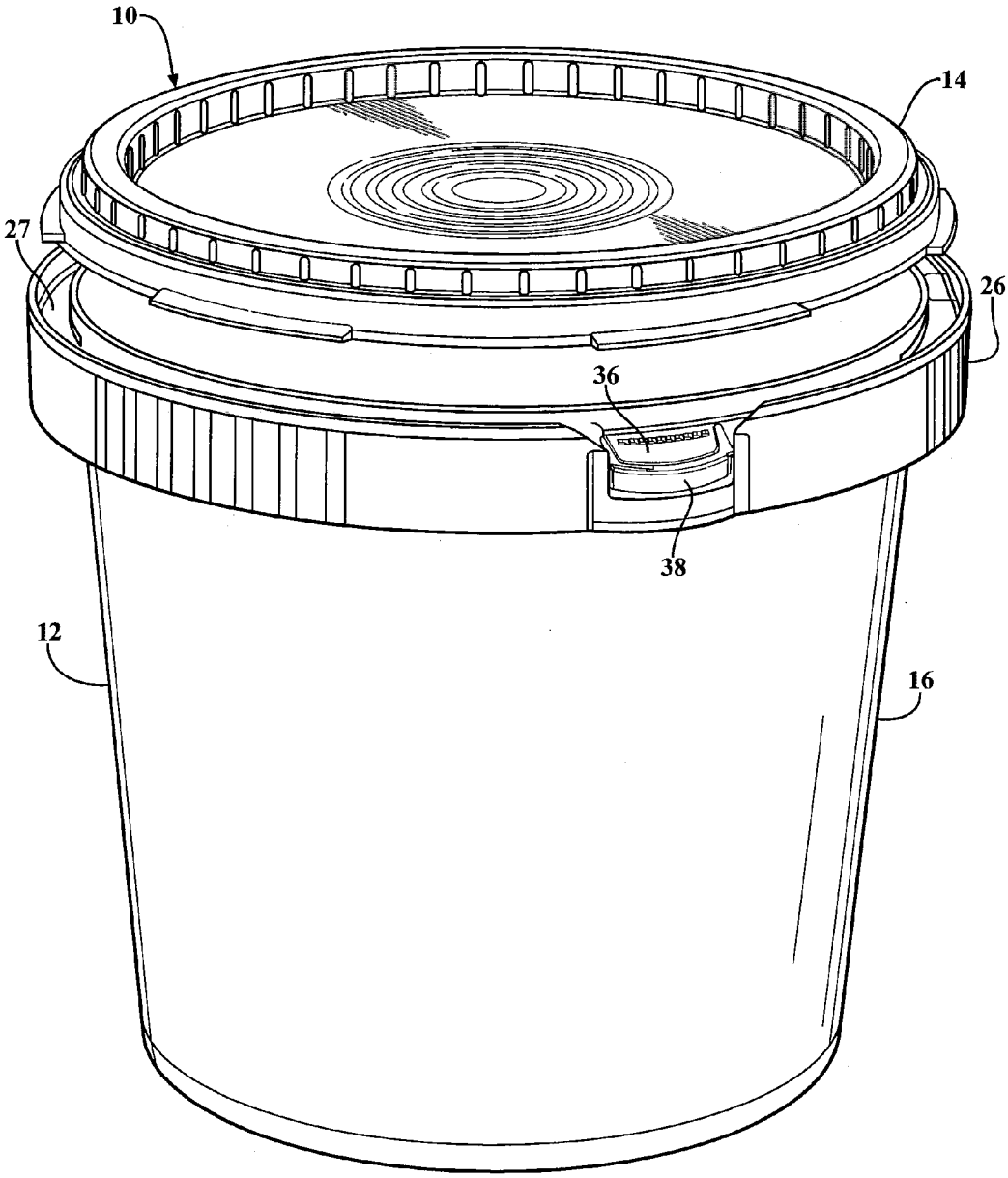
FIG. 1 is a perspective view of a first embodiment of a container/closure combination molded in a suitable plastic such as high-density polyethylene and incorporating all features of the present invention.
Figure 2:
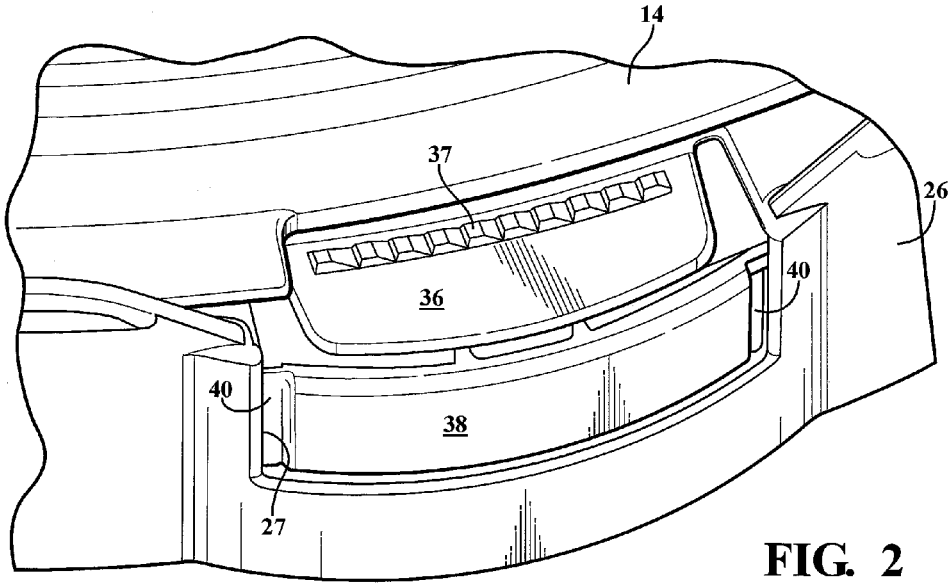
FIG. 2 is a perspective view of a latching detail involved in the closure removal function.

Referring to the figures, FIGS. 1-11 show a first embodiment of the invention in the form of a molded plastic container/closure combination 10 comprising a five-gallon, open top, molded plastic container 12 and a molded plastic closure 14 which is adapted to be mated to the container 12 so as to close and seal the container. In accordance with the various features of the invention hereinafter described, there is provided a tamper evident feature, a child resistant feature and a removal facilitation feature. The container 12 and closure 14 are preferably manufactured by injection molding high-density polyethylene in appropriate molds as are well known to persons skilled in the molding arts. The invention is, however, not limited to HDPE as a material of construction as other materials may also be used. The five-gallon size is given only by way of example.

The container 12 has a tapered sidewall 16 which terminates at the upper end in a rim 18 which is received within an inverted U-shaped peripheral channel structure 20 on the closure 14. The closure 14 is molded with an inverted U-shaped peripheral channel which receives the top edge 18 of the container and includes a gasket 45 held in place by a small retainer rib 24. Closure 14 includes an annular outer skirt 22 with integrally molded and uniformly angularly spaced, radially outwardly extending bayonets 30 formed thereon. In this example, six bayonets 30 are used and they each define an included angle of less than 30° with gaps of more than 30° between the bayonets. More or fewer bayonets 30 may also be used in which case the included angles change.

The container 12 is molded integrally with a "beam" 26 which takes the form of an annular collar, the top of which is essentially coplanar with the top rim 18 of the container 12. The beam 26 is approximately 1 inch to 1¼ inches in vertical dimension and extends continuously around the container sidewall except for a gap 27, the purpose of which is hereinafter described.

The beam 26 stands radially off of the container sidewall 16 about ¼" or more by means of an annular rib 28 upon which the bayonets 30 are seated when the closure 14 is placed on the container 12 in such a way as to cause the skirt 22 to extend downwardly into the radial gap between the container sidewall 16 and the outer portion of the beam 26, as shown in FIGS. 3A, 3B, 6 and 9. The rib 28 is not flat all the way around the container; rather, it slopes upwardly by elevated sections 34 which perform two functions: first, the elevated portion 34 lies in a plane which is higher than the plane of rib 28 so that the bayonets on the closure 14 can slide under them via one-way openings or slots when the closure is rotated in the locking direction. This rotation can continue until the bayonets reach an end stop 36. The term "slot" does not here imply that the rib 34 continues under the elevated portion 34. Indeed, the rib is generally relieved under most of the elevated portions 34. Secondly, the elevated portions 34 form ramps on their top surfaces which the bayonets ride up on to lift the closure relative to the container 12 approximately ¼" when the closure is rotated in the opening or unlocking direction; i.e., twice as far as is necessary to bring the bayonets 30 out from under the raised portions 34. The portions 34 can optionally be internally tapered downwardly to cam the closure down onto the top of the container 12 when rotated in the locking direction thereby to improve the seal between container and closure. A gasket seal can be provided as shown. Alternatively, a vented, gasketless design can be used.

Figure 3A:
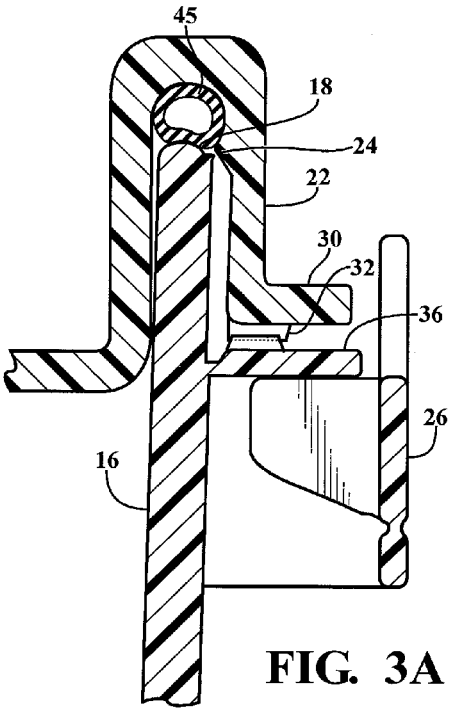
FIG. 3A is a sectional view through the closure and the container sidewall illustrating an audible rotation indicator function as well as a release function.
Figure 3B:
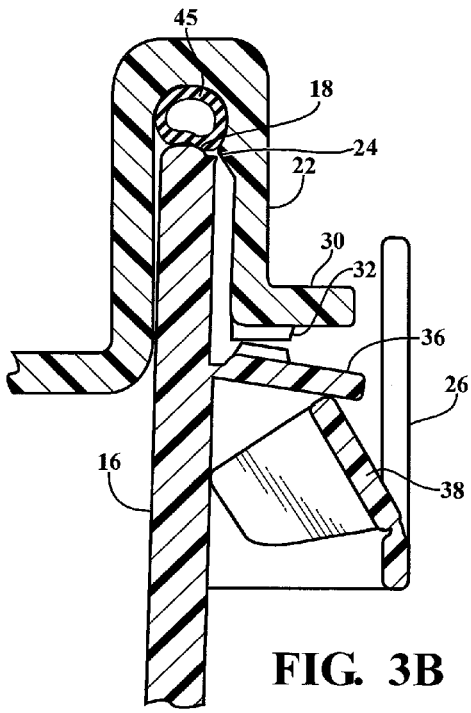
FIG. 3B is a sectional view of the same structure as shown in FIG. 3*a* but with the release tab in a deflected position.
Figure 4:
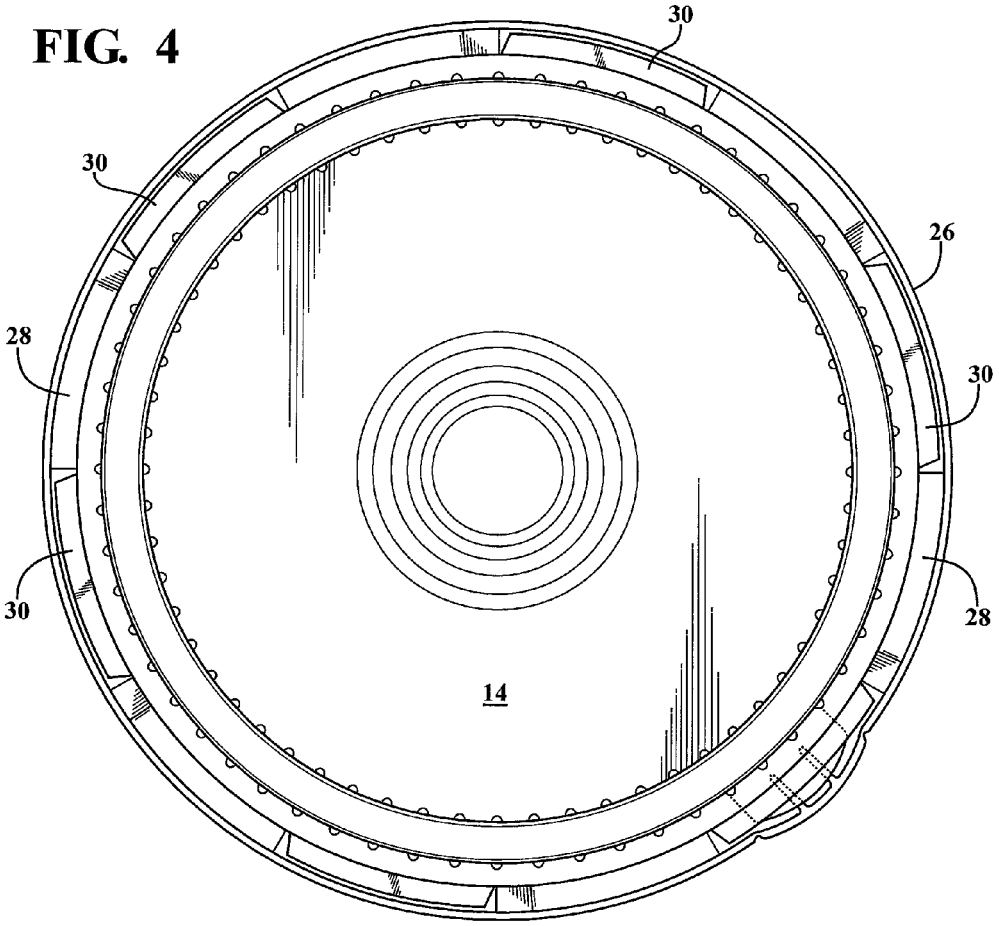
FIG. 4 is a top plan view of the structure of FIG. 1.
Figure 5:
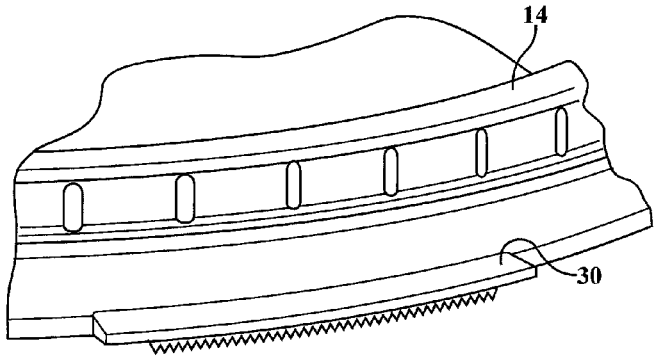
FIG. 5 is a perspective view of a detail of the closure.

As shown in FIGS. 3A and 3B, serrations 32 are formed on the bottom surfaces of the bayonets 30 to provide an audible indication of rotation relative to a container feature 36 hereinafter described.

As indicated above, the beam 26 is interrupted by a gap 27 within which is molded a release tab 36 having serrations 37 formed on the upper surface thereof. The serrations 37 coact with the serrations 32 on the bottoms of the bayonets 30 to provide the audible indication of rotation when the release tab is in a position which permits rotation of the closure 14 relative to the container 12. The release tab 36 is hinged at its inner extremity to the container sidewall such that it may be resiliently depressed downwardly out of its normal position where it prevents rotation of the closure 14 by interfering contact with the edges of the bayonets 30, to a lowered position where it no longer interferes with the bayonets 30 and therefore permits rotation of the closure 14 relative to the container 12 for locking and unlocking purposes. In the lowered position, the release tab allows coaction between the serrations 32, 37 as shown in FIG. 3B.

To provide a tamper evident feature, an arcuate latch 38 conforming generally to the container/closure combination is molded into the container sidewall with a living bottom hinge 39 and frangible side anchors 40. The latch 38 is located so as to prevent downward depression of the release tab 36. However, the frangible anchors 40 are thin and can be relatively easily fractured by pressing inwardly on the latch 38 after which the tab 36 can be pressed down, by bending it around the hinge 39 as shown in FIG. 3B to a position where the release tab 36 no longer interferes with the bayonets and therefore allows rotation of the closure 14 relative to the container 12 to permit the opening manipulation.

Figure 9:
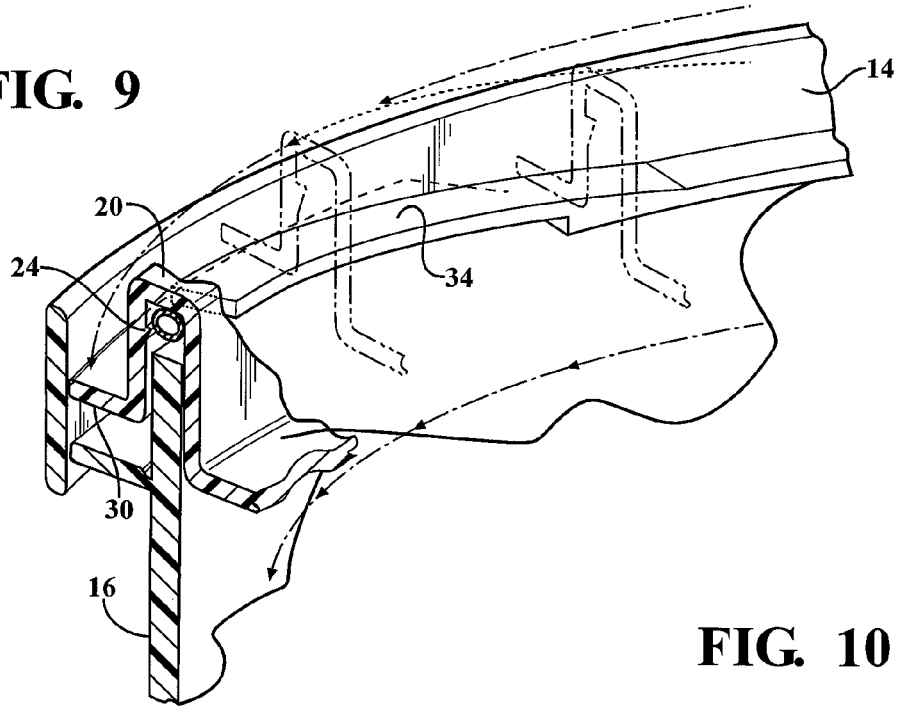
FIG. 9 is similar to FIG. 6 but illustrates how the closure rises relative to the container sidewall to facilitate removal.
Figure 10:
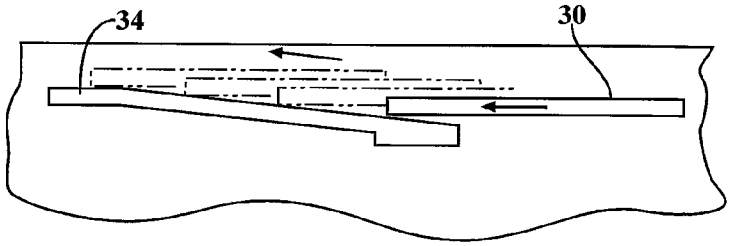
FIG. 10 is similar to FIG. 7 but indicates how the container and closure coact during removal rotation.
Figure 11:
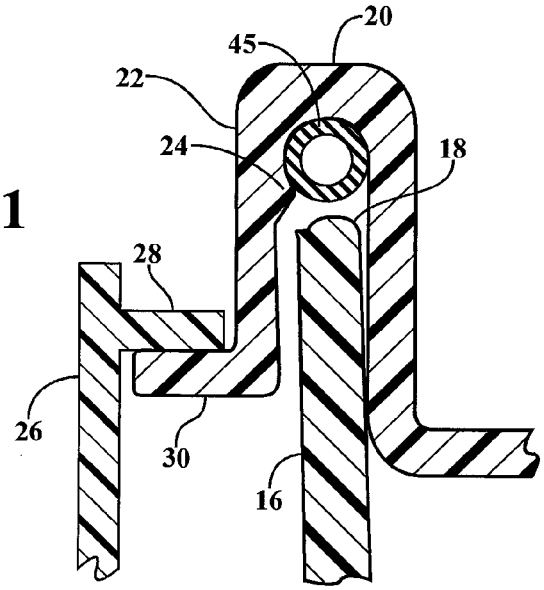
FIG. 11 is similar to FIG. 8 but indicates how the closure lifts relative to the container sidewall during a full removal process.

Summarizing, operation of the container/closure combination is essentially as follows: Once the container 12 is filled, the closure 14 is attached to the container 12 typically by machinery and the bayonets 30 are rotated into the horizontal slots provided by the riser portions 34 of the rib 28 until the release tab 36 is centered between bayonets 30, care being taken to prevent fracture of the anchors 40 on the sides of the latch 38. To remove the closure 14 from the container 12, one first depresses the latch 38 inwardly to fracture the anchors 40 until the release tab 36 may be pushed downwardly. With the release tab 36 deflected downwardly around its own living hinge, the closure 14 is rotated to bring the bayonets 30 out from under the raised portions 34 of the rib 28 until they are in the 30° clearance gaps between slots. At this point, the closure 14 may be removed by lifting it straight up, relative to the container 12. However, an additional assist feature is provided for the convenience of persons having limited manual dexterity through continued rotation of the closure 14 through another angle of rotation of approximately 30° thereby causing the bayonets to ride up on the ramps provided by the raised portions 34 thus lifting the closure 14 relative to the container 12 as best shown in FIGS. 9 through 11. Unlike a conventional screw thread, the risers 34 lift all bayonets at once and to the same degree until they sit atop the risers 34. Four features of the invention are thus provided:

(1) A tamper evident feature in the form of the fracturable anchors 40 which are broken to operate the latch 38;

(2) A child resistant feature which involves the combination of the latch 38 and the complex action required to depress the release tab 36 and rotate the closure 14 at the same time;

(3) A removal facilitation feature provided by ramps which coact with the bayonets 30 to lift the closure 14 relative to the container upon continued rotation of the closure 14 in the opening or unlocking direction. As indicated above, these features can be used individually as well as in combination; and (4) An audible indication of rotation.

Referring now to FIGS. 12-24, there is shown a second embodiment of the invention which can be generally similar to the first embodiment described above except for the details of the release mechanism. As in the previously described embodiment, the tamper evident feature is optional as hereinafter explained.

Figure 16:
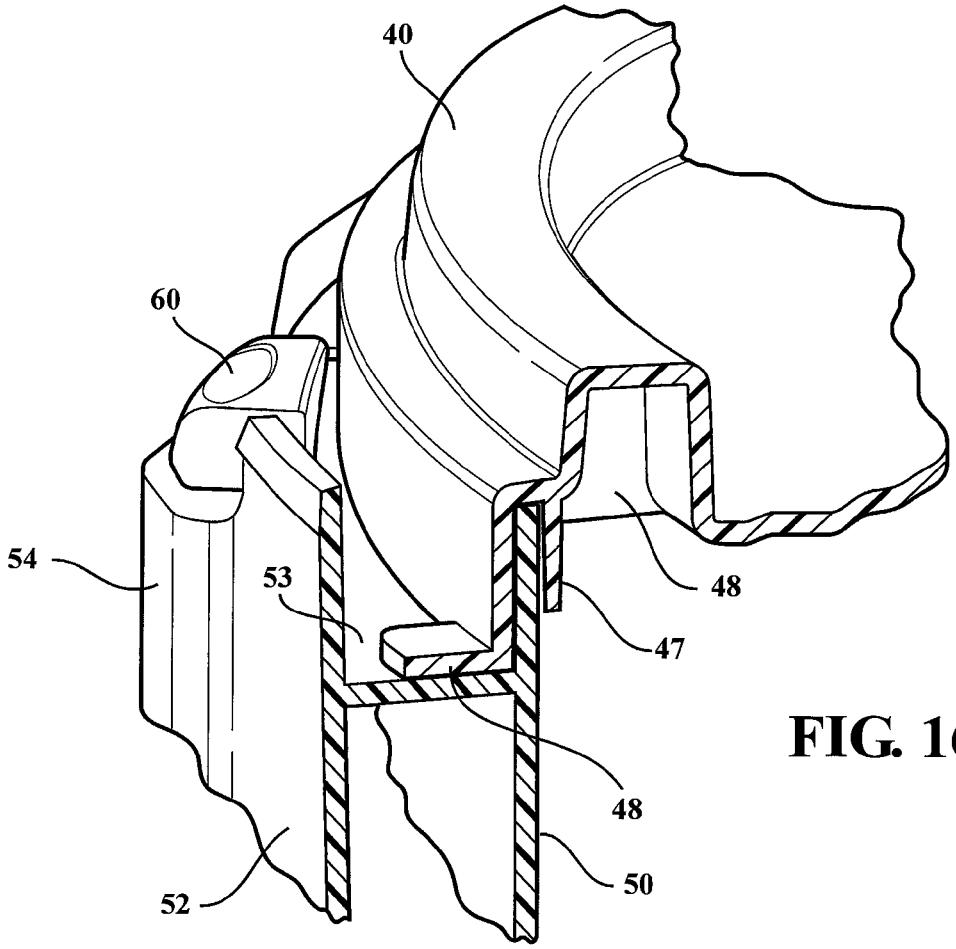
FIG. 16 is a first perspective view of the cutaway portions of the container and closure showing how the container sidewall fits into the closure.
Figure 18:
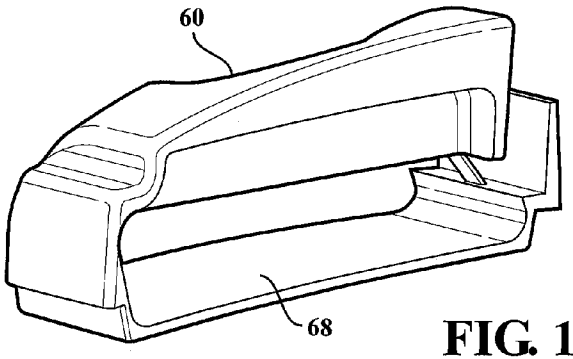
FIG. 18 is another perspective view of the release tab.
Figure 17:
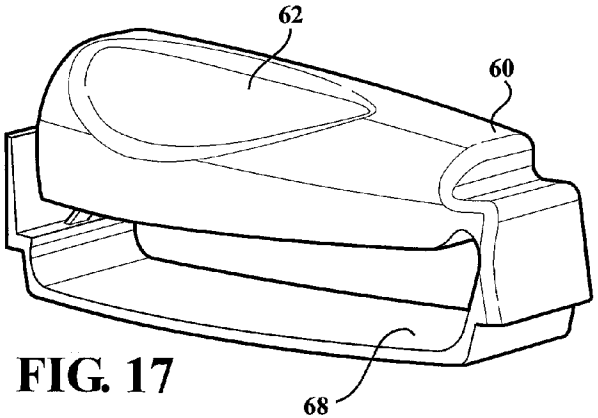
FIG. 17 is a perspective view of the release tab alone.
Figure 19:
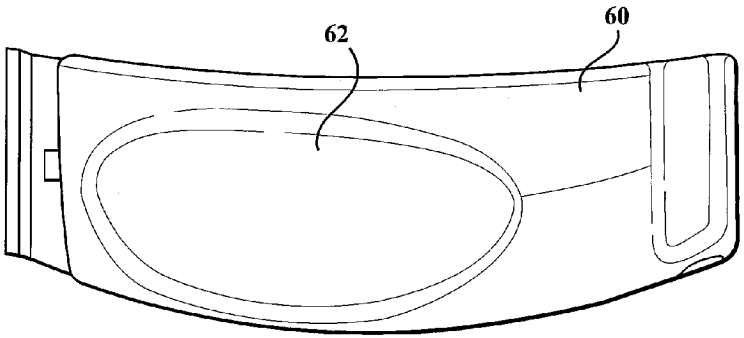
FIG. 19 is a top view of the release tab.

As shown in FIGS. 12-24, the second embodiment comprises a molded plastic closure 40 which is essentially identical to closure 14 of the first embodiment in that it comprises a circular center and a downwardly extending peripheral skirt 46 having a plurality of radially outwardly extending bayonet ribs 48. The bayonet ribs may be six in number and are uniformly circumferentially spaced apart by about twice their circumferential length. Just inside of, but radially spaced from, the skirt is an annular rib 47 which, together with skirt 46 defines an annular slot into which the top rim of the container 50 fits as shown in FIG. 16. The closure also includes on the top side an annular structure 42 with a plurality of circumferentially spaced ribs 43 on the outermost surface as well as a plurality of internal ribs 45 shown in FIG. 5. The structure 42 stiffens the closure 40 and acts as a gripping point for the user to rotate the closure 40 relative to the container 50 during locking and unlocking operations.

Figure 12:
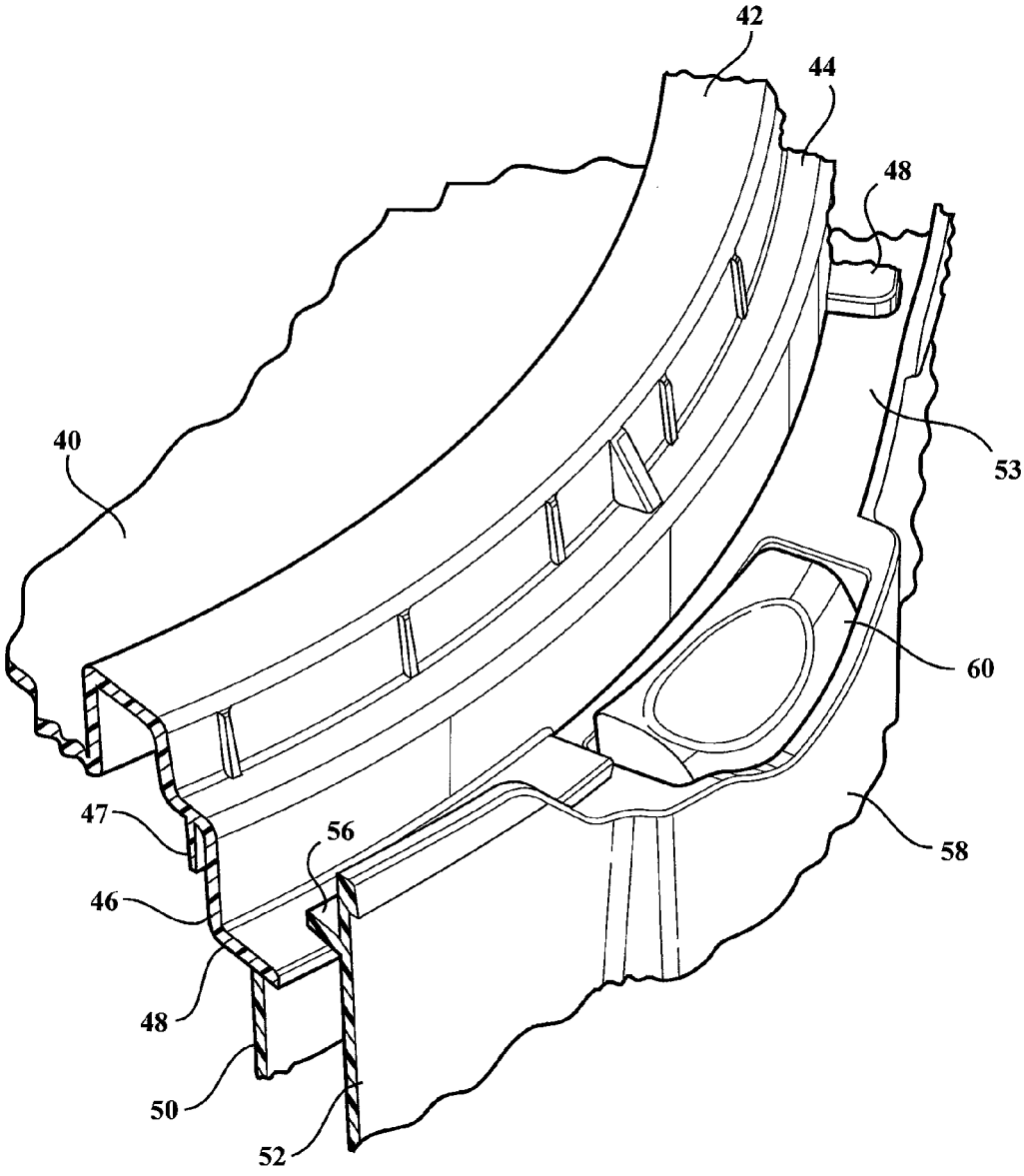
FIG. 12 is a perspective view of a second embodiment including a modified release mechanism.
Figure 13:
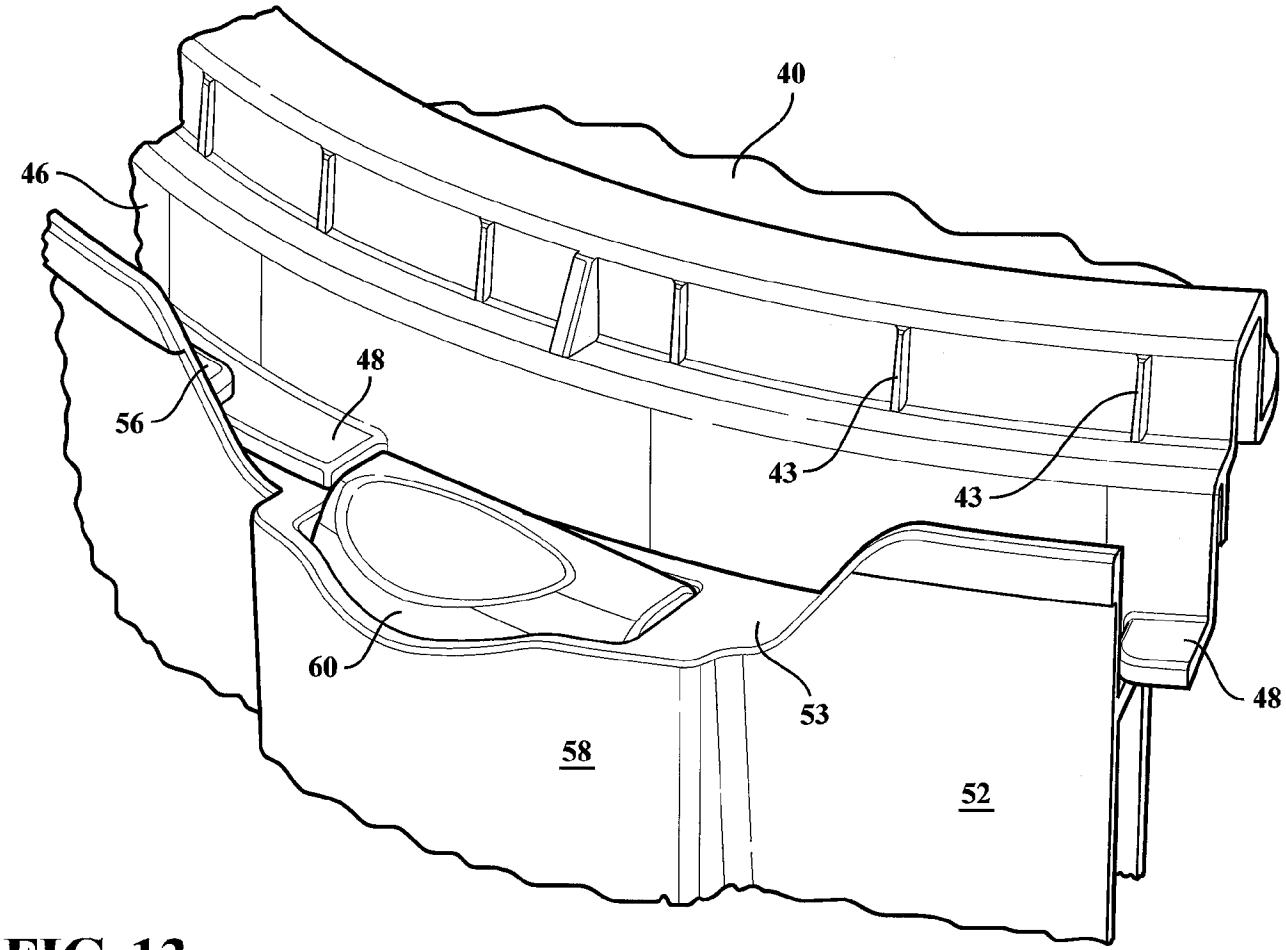
FIG. 13 is another perspective view of the release mechanism showing a portion of the container sidewall structure and a portion of the closure.
Figure 14:
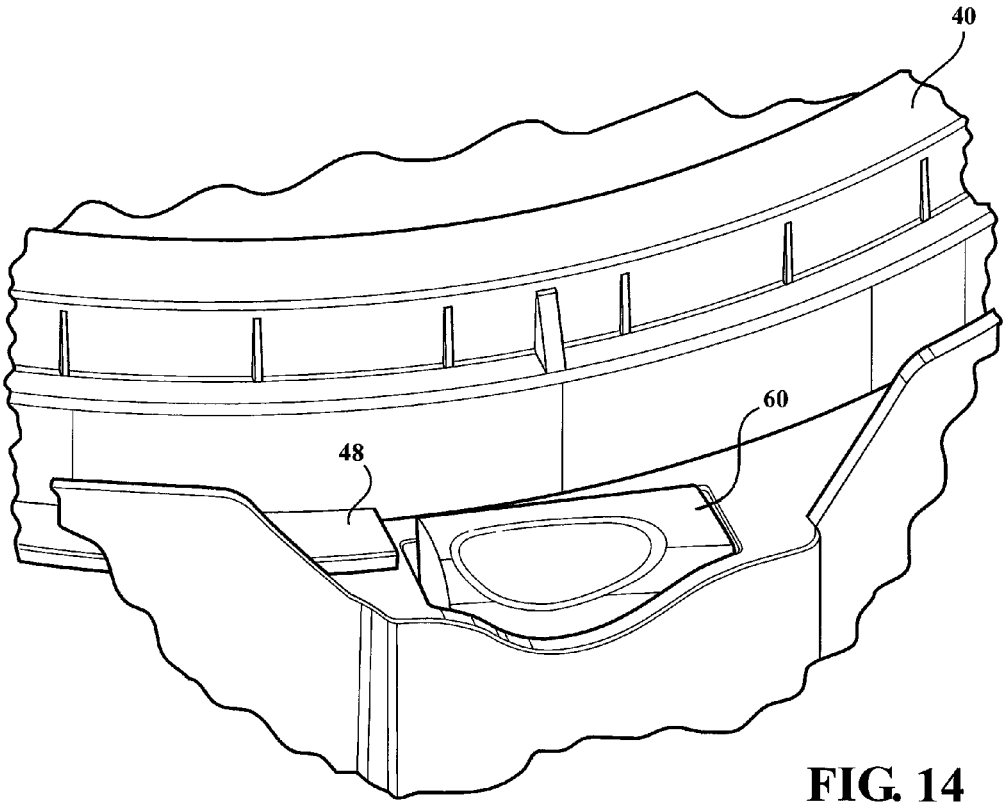
FIG. 14 is another perspective view of the release tab with a portion of the closure structure in proximity thereto.
Figure 15:
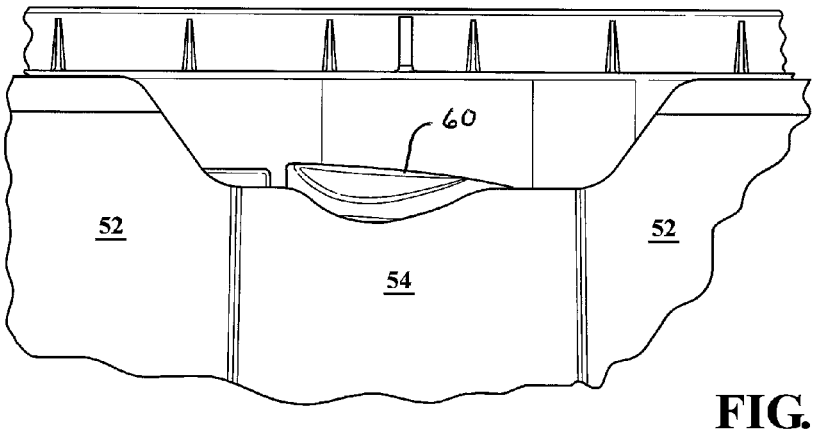
FIG. 15 is a side view of a portion of the container and closure.

The container 50 is generally similar to the container 12 of the first embodiment in that it is of tapered cylindrical configuration and includes an annular beam structure 52 spaced outwardly from the container sidewall by an annular rib 53. In the second embodiment, the beam section 52 has a radially outwardly-extending deck area 58 that holds a release tab 60 that is upwardly biased so that it lies interferingly between two adjacent bayonets 48 when the closure is locked on the container 50. As such, the left edge of the release tab 60, because it extends above the surface of the rib 53, on which the bayonets slide, must be depressed before the closure 40, as shown in FIGS. 12 and 13, can be rotated counterclockwise (to the right) to release the closure 40 from the container 50 by rotating the closure bayonets out from under the raised portions of the rib 53. The top of the tab 60 is sloped so that the interference with bayonets 48 is unidirectional; i.e., the tab stops rotation only in the unlocking direction. The rib has a plurality of raised portions 56 which lie in a plane higher than that of the rest of rib 53 such that the bayonets 48 can slide into "slots" between the rib 53 and the ribs 56 as the closure 40 is rotated into the locked position. In short, the operation of the bayonets and slots in the second embodiment is the same as that of the first embodiment. As hereinafter described, the release tab 60 is resiliently mounted within the structure of the outwardly-projecting area 58 in the beam 52 so that it normally occupies the interfering position shown in FIGS. 12 and 13, but can be pressed down to allow rotation of the closure relative to the container when the user wishes to open the container.

Figure 20:
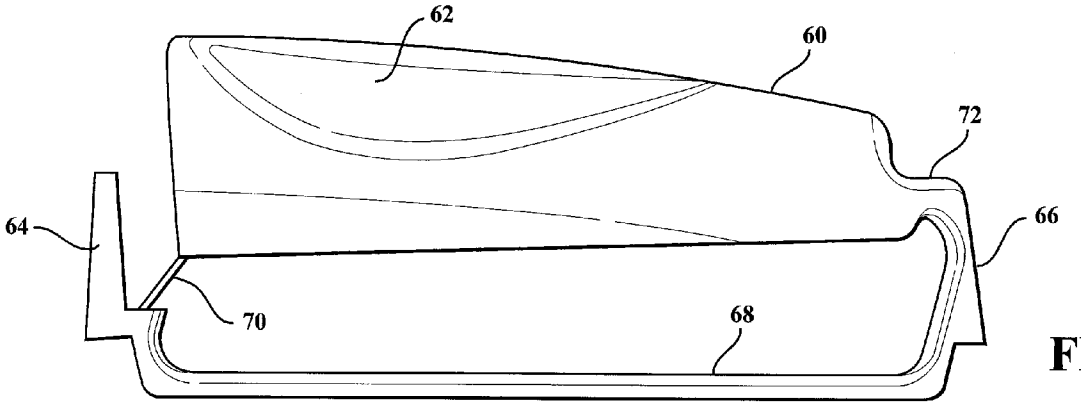
FIG. 20 is a side view of the release tab.
Figure 22:
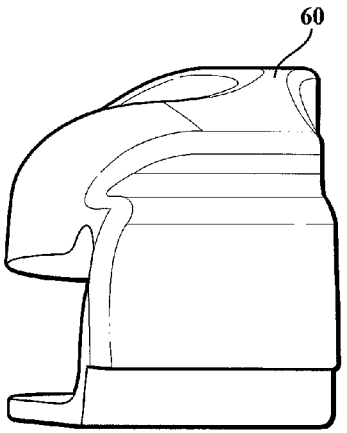
FIG. 22 is a another end view of the release tab.
Figure 21:
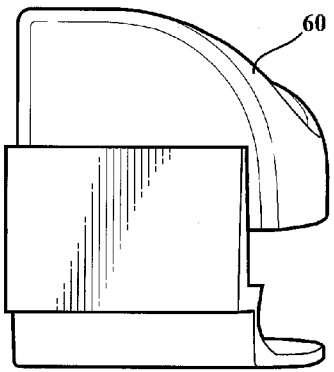
FIG. 21 is an end view of the release tab.
Figure 24:
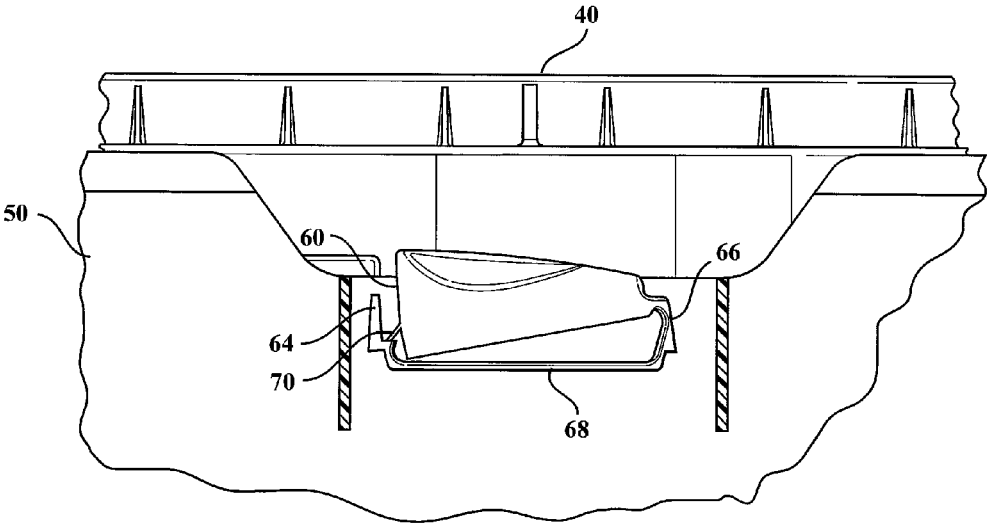
FIG. 24 is a side view of a portion of the container side structure and the closure structure showing an optional tamper-evident feature of the release tab.

As shown in FIGS. 17-20 and 24, the release tab 60 is a separate molded plastic element having a concave thumb pad 62 and a base comprising sidewalls 64, 66 and a flat floor 68. An optional web 70 interconnects the left side of the thumb pad 62 to the sidewall 64. The connection between the right sidewall 66 and the thumb pad 60 forms a living hinge or spring pivot 72 which allows the upper thumb pad section 62 to be resiliently pushed downwardly toward the flat floor 68 as shown in FIG. 24. By "resiliently", we mean that the tab wants to reform to the raised position and will do so when downward pressure is released. The thumb pad section 60 is higher on the left end than it is on the right end as shown in FIGS. 20 and 24 because only the left edge is involved in providing the interference between the release tab 60 and the edge of a bayonet to prevent rotation of the closure before the thumb pad 62 of the release tab 60 is pushed downwardly. The web 70 can be made thin so as to break whenever the thumb pad 62 is pushed fully downwardly past the point necessary to release the closure 40 for rotation. This optionally provides the tamper evident feature. If this feature is not desired, the web 70 may be eliminated so that the living hinge provides the spring function by itself.

Figure 23:
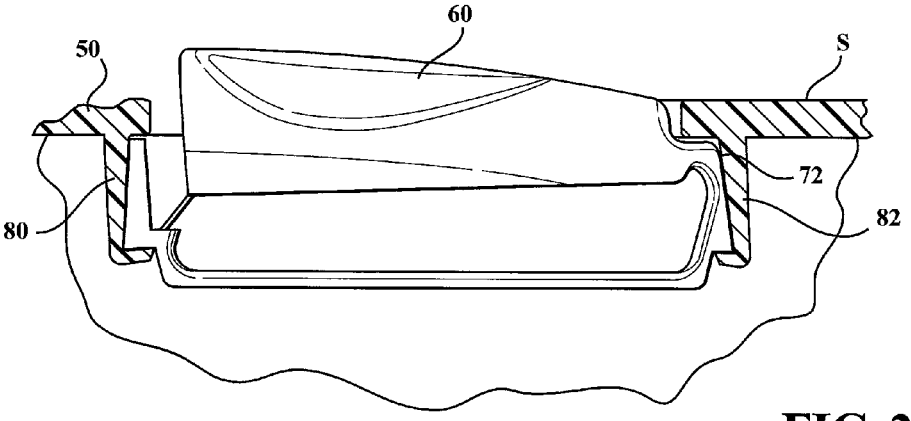
FIG. 23 is a side view of the release tab showing how it is snap-fit mounted into the container beam structure.

As shown in FIG. 23, the release tab 60 is mounted in and to the structure 54 by snapping the release tab 60 upwardly into position between molded plastic ribs 80, 82, which are molded integrally with the beam 52, 53 and provided with inwardly directed projections on the bottom ends thereof. Ribs 80, 82 extend vertically downwardly from rib 53. The release tab 60 has seats and the sidewalls 64 and 66 to cooperate with the projections on the bottom of ribs 80, 82. The rib structures 80, 82 are flexible enough to deflect outwardly to allow the release tab 60 to be snapped upwardly into place from the underside of the deck portion of rib 53 and mounted as shown in FIG. 23 wherein the thumb tab 62 projects upwardly through the opening in the rib 53 as shown, for example, in FIG. 13.

By way of summary, the closure 40 fits onto the container 50 and such that the bayonets 40 interact with the ribs 53 and 56 in the beam portion of the container body so as to lock the closure 40 down with the bayonets 40 under the ribs 56 when the closure is rotated clockwise far enough to move the bayonet 48 past the left edge of the release tab 60 as shown, for example, in FIGS. 12 and 13. At this point, the closure 40 is nearly completely locked in place. Rib 53 provides an annular surface on which the bayonets 40 can slide during rotation.

To remove the closure, it is first necessary to depress the thumb pad portion 62 of the release pad 60 far enough to permit the closure 40 to be rotated counterclockwise until one of the bayonets 48 overlies the release tab 60. At this point, all of the bayonets are resting on rib 53 between the overlying ribs 56 and the closure 40 may be lifted up and off of the container 50. The closure 40 is reattached by reversing this process and, unless the spring 70 is made frangible and is fractured by the first release operation, the release tab 60 remains operable for future removals of the closure 40 from the container 50. If the release tab is constructed without the frangible web 70 as shown in FIG. 23, the living hinge 72 on the right side of the tab 60 acts as a permanent spring biasing the tab to the uppermost, interfering position, but allowing it to be resiliently depressed to permit rotation of the closure 40 in the opening direction.

To summarize, the invention has been disclosed with respect to two embodiments; i.e., the embodiment of FIGS. 1 to 11 and the second embodiment of FIGS. 12 to 24. In the first embodiment, removing the closure 14 requires fracturing element 38 so that the release tab 36 can be depressed far enough to permit rotation of the closure 14 until the bayonets 30 clear the slots in which they were previously locked. In the embodiment of FIGS. 12 to 24, the end user simply depresses the spring biased release tab 60 by placing his or her thumb on the thumb pad 62 and pressing downwardly to pivot the release tab against the resisting forces of the integral hinge spring 72 until the left edge of the release tab 60 is low enough to permit the closure 40 to be rotated without interference into an unlocked position. Once the bayonets have been rotated out of the locking slots formed by elements 56 and lie between two adjacent elements 56, the closure 40 may be lifted upwardly and removed from the container 50. The embodiments may have all or any combination of the features described in paragraphs 0006 to 0008 above.

The invention has been described with reference to two illustrative embodiments. Various changes in design, size and proportions are possible within the scope of the invention.

What is claimed is:

1. A container/closure combination comprising:

an open top molded plastic container having a sidewall, a top rim and an annular beam proximate said rim, said beam being spaced radially outwardly from said container sidewall by a rib having a plurality of alternatingly upper and lower portions;

a molded plastic closure having a center portion surrounded by an annular rim having an outer skirt;

a plurality of circumferentially spaced, radially outwardly-extending bayonets formed on said skirt which rest on the lower portions of said rib but can be rotated under the upper portions of said rib by turning the closure on the container, the circumferential spacing between said upper and lower portions and the circumferential dimensions of said bayonets being such that the bayonets can be rotated onto said lower portion for removal of said closure from said container; and a release tab attached to a lower portion to normally interfere with rotation of said bayonets but being resiliently depressible to allow rotation of said closure, wherein the release tab is separately formed relative to said container.

2. The combination described in claim 1 wherein the container and closure made of injection-molded high density polyethylene.

3. The container/closure combination defined in claim 1 wherein:

all of the upper rib portions lie in a first plane and form a first discontinuous surface; all of the lower rib portions lie in a second plane below the first plane and form a second discontinuous annular surface; adjacent first and second surface portions being joined by ramp surfaces extending in the same annular direction from said lower portion to said upper portion;

said closure having an inverted U-shaped channel configured to receive said rim therein and sealable with respect to said rim;

said bayonets resting on said surface and being movable by rotation of said closure relative to said beam in one direction so that the bayonets underlie respective upper portions of said ribs and said channel takes on a sealed relationship to said rim; said closure being rotatable in the opposite direction to a second angular position in which the bayonets rest on said lower surfaces to allow the closure to be removed from the container, wherein further rotation of said closure in said opposite direction causes said bayonets to ride up said ramps to rest on said upper surface thereby to unseal said channel from said rim.

4. A container/closure combination as defined in claim 3 wherein the upper and lower surfaces are interconnected by a circumferential series of ramp surfaces that allow the bayonets, when the closure is rotated in a selected direction, to lift the closure away from the container rim.

* * * * *